US005924647A

United States Patent [19]

Dorfel

[11] Patent Number: 5,924,647

[45] **Date of Patent: *Jul. 20, 1999**

[54] WINDING MACHINE

[75] Inventor: Walter Dorfel, Boll, Germany

[73] Assignee: Beloit Technologies, Inc., Wilmington, Del.

[ * ] Notice: This patent is subject to a terminal disclaimer.

[21] Appl. No.: 09/119,179

[22] Filed: Jul. 20, 1998

Related U.S. Application Data

[63] Continuation of application No. 08/793,740, Aug. 14, 1997, Pat. No. 5,829,709

[30] Foreign Application Priority Data

Sep. 6, 1994 [DE] Germany ..... G9414449

[51] Int. Cl.[6] ..... B65H 18/20

[52] U.S. Cl. ..... 242/542; 242/541.4; 242/541.7

[58] Field of Search ..... 242/541.4, 541.7, 242/542, 542.4

[56] References Cited

U.S. PATENT DOCUMENTS 3,346,209 10/1967 Cronin .
3,497,151 2/1970 Voss et al. .
5,478,026 12/1995 Schonmeier et al. .
5,492,287 2/1996 Raudaskoski et al. .
5,499,779 3/1996 Raudaskoski .
5,562,261 10/1996 Beisswanger et al. .

FOREIGN PATENT DOCUMENTS

631955 A2 1/1995 European Pat. Off. .
4110047 A1 10/1992 Germany .

*Primary Examiner*—John P. Darling
*Attorney, Agent, or Firm*—Vickers, Daniels & Young

[57] ABSTRACT

A winding machine for winding up webs, possibly longitudinally divided webs, and preferably paper webs. The winding machine comprises two support rollers which support, in a winding bed, the roll to be produced. During the winding process, the web running through the spacer gap between the two support rollers partially wraps around one of the two support rollers. The winding machine further comprises a space delimited by the two support rollers, the partly formed roll, and this space has sealed closures on its ends and a sealed closure below the spacer gap between the two support rollers. Finally, the winding machine generates excess pressure in this space in order to balance the inherent weight of the roll. The sealed closure below the spacer gap comprises a pivotable side wall which extends substantially over the entire maximum web width of the roll to be produced and whose pivot axis extends approximately parallel to the support rollers axes. The side wall can be pivoted sealingly towards the support roller, around which the web is wrapped, while leaving free a web passage gap for the winding process. The side wall can be moved, in particular pivoted, away from the support roller, around which the web is wrapped, for the introduction of the web.

31 Claims, 3 Drawing Sheets

SR
R,R',R'',R''',...
TW2
M2
TWA2
20
21
A-A
23
24
22
14
15
23
19
18
31
30
28
27
16
25
26
29
11A
11
12
13
12
13
12
14A
E
RE
TW1
M1
R
DR
G
PB

M2
TW2
Ø DRUM
DR
max
min
RE
E
14
14A
14B
16
17
17A
18
19
20
21
22
23
24
25
26
29
30
11
GR
TWA2
A
I

WINDING MACHINE

The present application is a continuation of U.S. application Ser. No. 08/793,740, filed Aug. 14, 1997 now U.S. Pat. No. 5,829,709, entitled "Winding Machine."

This invention concerns a winder for winding webs and preferably paper webs divided lengthwise, with two king rolls supporting the roll to be formed in a winding bed, of which each comprises a deformable cover, one having a different deformability than the other, the deformable cover preferably of soft, compressible material, whereby the running web passing through the separation gap between the two king rolls is partly wound around one of the two king rolls during winding.

BACKGROUND OF THE INVENTION

It is known to generate gas superpressure in the space defined by the two king rolls and the partially produced winding and a lower seal and end walls, in order to achieve a winding structure that is as uniform as possible and that minimum winding errors with rolls to be wound that become increasingly heavier, which, with increased diameter, completely compensates for the increase in weight (DE-GM 92 01 791; DE-PS 1,047,001; DE-PS 1,111,496; U.S. Pat. No. 3,497,151; U.S. Pat. No. 3,346,209; WO 92/03366; DE 4,110,047 A1).

As is especially clear from DE 4,110,047 A1, which is hereby incorporated by reference in the disclosure of the present invention, it is required in these pneumatic support devices that both the winding space above the smallest gap of the support rollers and the winding space below it be sealed, forming a wind box (or blast box) with, for example, applied compressed air. For sealing the lower winding region, the winding box has side walls in the form of circular segments, which are adapted in shape to the external cross section of the two king rolls in such a way that between the outer surfaces of the wind box and a circular arc of each king roll, there remain uniform gaps that are as small as possible. The web to be wound passes advantageously through one of these two gaps. Although the two king rolls are arranged stationary, the long length of the king roll, which can exceed 8 or 10 m, imposes high requirements on the exact placement of the gaps between the king rolls and the parallel portions of the side walls of the wind box, which gaps are to be as small as possible. Since in changing a roll or threading in a new web to be wound, the gap between the enclosed king rolls and wind box is too small, it is envisioned according to DE 4,110,047 A1 that the wind box be swung away downward by means of an arm mechanism provided around a king roll around which the web is wound. Moving the whole wind box imposes significant requirements on the positioning of the wind box in the working position in order to avoid an air gap between the wind box that is on the one hand neither too large, i.e. requiring the use of high air pressure, nor on the other hand too small, causing occasional contact when moved.

Sealing of the upper winding space is only required at its two ends, but here the problem to be overcome is that the available sealing surface has a relatively small area, which makes a contact-free sealing with the least possible pressure loss more difficult. The sealing surfaces provided for the sealing task can only be brought into position when the roll being formed has reached a diameter large enough that the sealing surfaces can be swung between the winding core guidance device and one of the king rolls. This is only possible beginning with a relatively large winding diameter, because of the significant width of the upper spandrel space. In addition, it requires the upper and lower parts of the wind box to be separately swingable and the separation plane to be positioned at the tightest position between the king rolls, which further increases the sealing problem.

SUMMARY OF THE INVENTION

Starting from this, the goal of the invention is to reduce the problems of sealing in winders with two king rolls supporting the roll to be formed in a winding bed, of which each comprises a deformable cover, one having a different deformability than the other, the deformable cover preferably of soft, compressible material, whereby the running web passing through the separation gap between the two king rolls is partly wound around one of the two king rolls during winding, with a space delimited by the two king rolls and the already partly formed rolls, with means for sealing this space at its front ends and from underneath of the separation gap between the two king rolls, and with a means for generating superpressure in the space for the purposes of relieving the weight of the rolls.

Another goal of the invention consists in making it possible to reduce the pressure load of the roll being formed even at an especially small roll diameter and thereby improve the roll structure.

Another goal of the invention consists in improving the roll structure by combining king rolls with yielding or soft surfaces, especially through a combination of king roll surfaces which yield to different degrees, and using the air-lift principle.

Finally, another goal of the invention consists in automating the threading of the roll being formed between the king rolls in the winding position in winders.

To achieve these goals a winder formed with sealing means being arranged stationary below the separation gap and comprising a swingable side wall extending essentially over the entire maximum web width of the roll to be formed, the swing axis of which is approximately parallel to the axes of the king rolls and can be swung towards the king roll around which the web is wrapped, leaving a gap for the web to pass through and forming a seal for the winding process, and can be moved away, specifically swung away, from the king roll around which the web is wound.

With a specific embodiment of the invention, threading, in particular automatic threading of the web to be wound between the king rolls to the roll start position, is made easier.

With one embodiment of the invention wherein sealing surfaces each having partial surfaces that can be swung away from the sealing position about an axis extending along a swing axis essentially perpendicular to the winding axis or the roll, so that the swing radius of the sealing surface when the partial surfaces are swung away from the rolls is reduced in comparison to the front end surfaces of the roll, can be implemented advantageously in winders of the generic type, independent of where the web to be wound is not fed between the king rolls, it is possible, in spite of a good sealing performance to make the swing radius for the sealing surfaces for the upper spandrel region significantly smaller than has been known.

Since the sealing device for the lower spandrel region remains in position between the two king rolls, because one side wall of the winding box can be swung and, advantageously remains there, it becomes possible for the first time to position the horizontal separation plane between the sealing devices for the lower and upper spandrel regions directly above the narrow space between the two king rolls and thereby improve the possibilities for sealing and precisely positioning the side walls of the wind box. These possibilities are improved still further by other features of the invention.

The components used in the invention mentioned above, as well as those claimed and described in the examples, are not restricted to a specific size, shape, selected materials, technical designs or any special conditions, so they can be used in any field of application with known selection criteria without restriction.

BRIEF DESCRIPTION OF THE DRAWINGS

Further details, characteristics, and advantages of the object of the invention will be made clear in the following description of the attached figures, in which as an example a preferred embodiment of the winder according to the invention is represented.

DETAILED DESCRIPTION OF THE INVENTION

Figure 1:
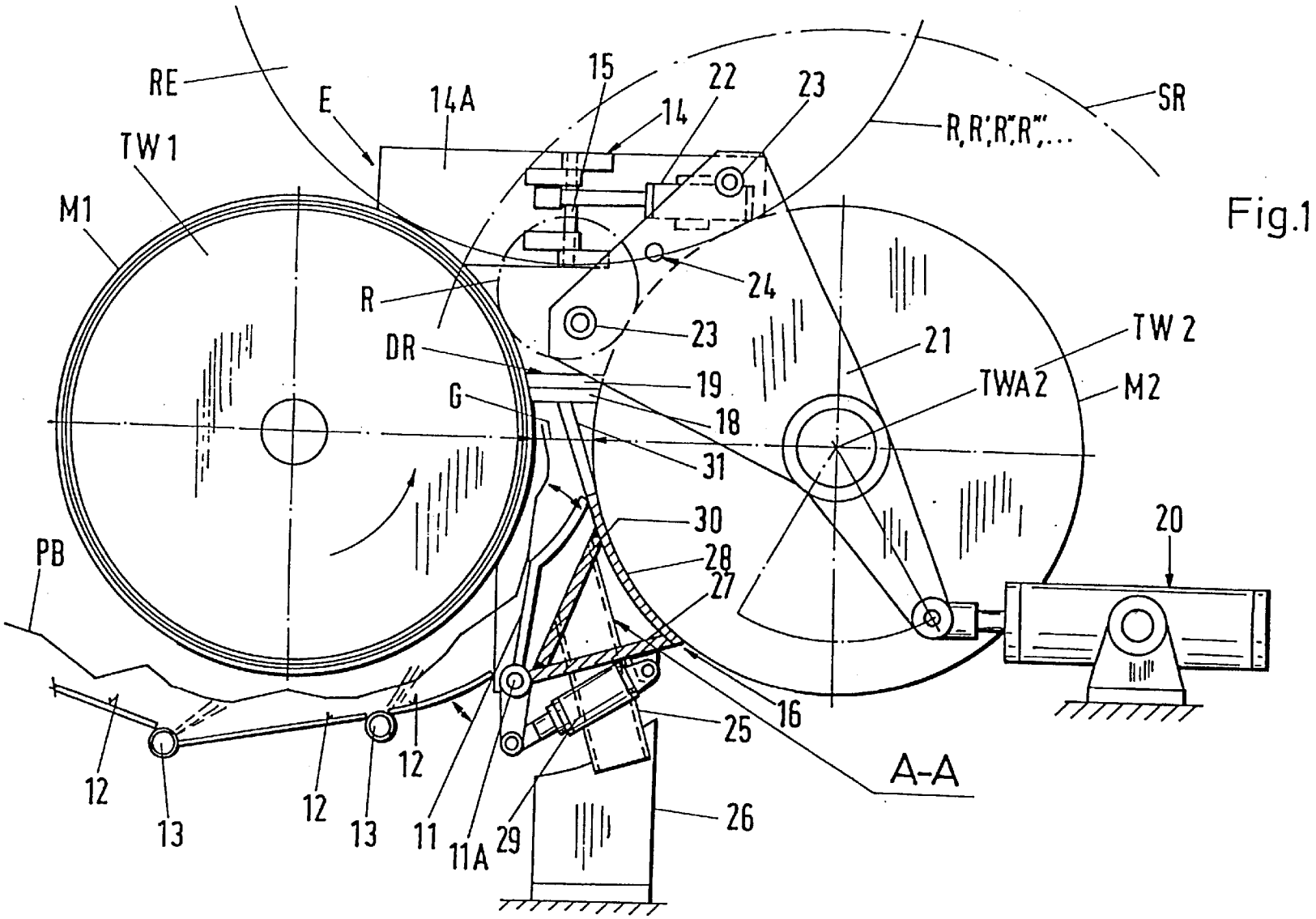
FIG. 1 shows a plan view of the part of a winder that is essential to the invention in a working position during change of the roll, with part of the wind box cut away.

As can be seen from FIG. 1, two king rolls with parallel axes (TW1 and TW2), with a constant minimum separation gap (G) of their radial covering surfaces (M1 and M2), are arranged with bearings so as to rotate. At least one of the king rolls can be driven. The covering (M1) of the first king roll (TW1) in the machine direction, can be deformed more elastically than that of the covering (M2) of the second king roll (TW2) in the machine direction. In the diagram, both king rolls have the same diameter and are at the same height, but they also can be different in diameter and height. In particular, the first king roll may have the larger diameter and the lower axle position. Of the two king rolls, the one that is the king roll with the greater total load resulting from static and dynamic load during winding is the one that has the more elastically deformable covering.

The Roll R or partial rolls (R', R", R'", . . . ) generated by lengthwise division (slitting) of the web, such as a paper web, not shown here, to be wound onto the two king rolls, seals the spandrel space between the two king rolls, which are located above the separation gap (G) (upper spandrel space), from top to bottom.

Figures 3, 4:
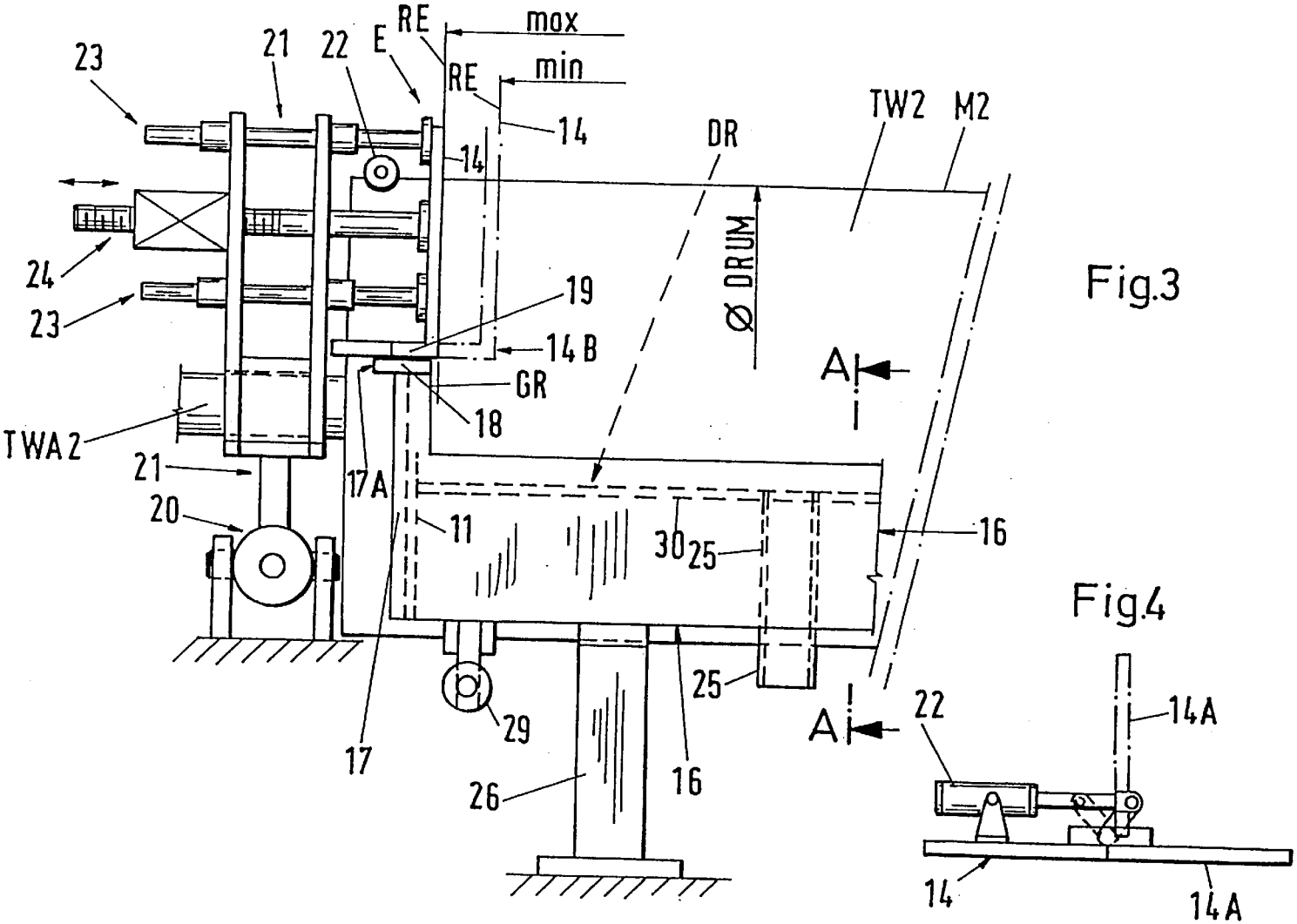
FIG. 3 shows a front view of the same winder from the direction of the web feed, with the first king roll omitted.
FIG. 4 shows for the same winder a plan view of the top sealing surfaces for the upper spandrel space in two working positions of the swinging partial surface.

Around the axis (TWA2) of the second king roll (TW2) end sealing surfaces (14) for the upper spandrel space are located at the front ends (E) and are arranged by means of a piston/cylinder unit (20) and a dual-arm lever (21) so as to be capable of swinging into a working position and—for the first winding period—out of the working position. The radially outermost region of the sealing surface (14) (with respect to the axis of swinging (TWA2)) is formed as a partial surface (14A), which, starting from the sealing position shown can be swung for about 90° around an axis that is essentially perpendicular to the winding axis (15), so that the swinging radius (SR) of the sealing surface (14) with the partial surface (14A) swung away from the roll R is reduced with respect to the partial surface (14A) being in its sealing position at the roll R. In FIG. 4 the sealing position is shown with solid lines and the swung-away position is shown with dotted lines. A piston/cylinder unit (22) serves for the swinging away. At the lower end of the nonswingable part of the sealing surface (14), which can only be rotated about axis (TWA2), is a sealing plate (19) that extends approximately parallel to the axes of the king rolls, and extends axially outward from the sealing surface (14) and, working in cooperation with a sealing table (18) of the wind box (16) to be explained later, provides sealing of the winding box between the upper and lower spandrel regions at various winding widths. As is also clearly seen from FIG. 3 (solid and dotted positions of the sealing surfaces and sealing plate (19)), an adaptation is thereby provided to the maximum and minimal widths of the roll to be formed, which makes it possible for the sealing surfaces (14) to lie on its front surface (RE).

Guides (23) and a setting device (24) provided on the dual-arm lever (21) serve for adapting to winding widths and setting a sealing gap that is as contact-free as possible between the sealing surfaces (14) and the front surface (RE), and are basically already known from DE 4,110,047 A1.

The lower spandrel region between the two king rolls (TW1 and TW2) and the lower zone of the upper spandrel region are sealed by a fixed wind box (16) that is open from above, so that it by working together with the two king rolls, the roll, and the sealing surface (14) forms a pressure space (DR) that is sealed on all sides for compressed air (air-lift fluid) which can be supplied through several pipes (25) distributed along the width of the king rolls. The wind box (16) is borne by fixed supports (26).

Figure 2:
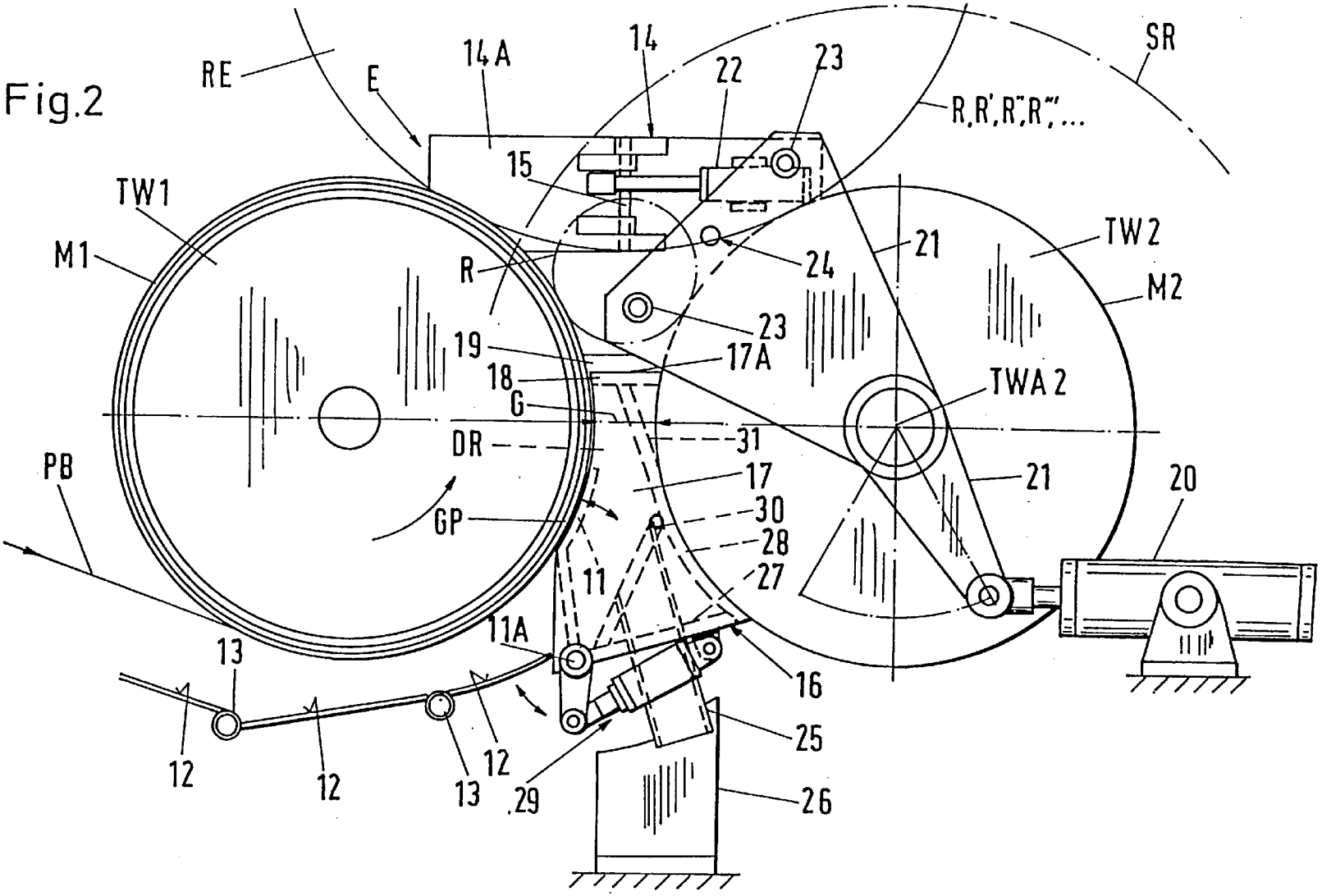
FIG. 2 shows the same view of the winder according to FIG. 1 in a working position during winding supported by compressed air.

The wind box (16) essentially consists of a bottom plate (27), which is penetrated by the pipes (25), of a fixed wall (28), essentially in the shape of a circular arc, which is adapted in shape to the second king roll (TW2), leaving a small sealing gap, and attached firmly to the wind box (16), and of another side wall (11), that essentially extends over the entire maximum web width of the roll to be formed and can be swung about a swing axis (11A), which extends approximately parallel to the king rolls. This side wall (11) can be moved towards the king roll (TW1) around which the web (PB) to be wound is wrapped, while leaving a web separation gap (GP) to form a seal for the winding process (FIG. 2, dotted lines). For the threading process of the web (PB), it can be swung away from the king roll (FIG. 1, solid lines). The length of the gap extending in the machine direction (web running direction) through which the web (PB) passes results from the arm length of the swingable side wall (11), which is bent so as to fit the outer surface of the first king roll (TW1). A piston/cylinder unit (29) on the wind box (16) serves to swing the side wall (11). The torsion strength of the wind box (16) and additional support for the pipes supports is provided by diagonal braces or plates (30), which are connected, specifically welded, to the bottom plate (27) and the fixed side wall (28), in a pressure-sealed manner. At the front ends the winding box (16) is closed by front walls (17) so as to be pressure-sealed. The desired stability of the sealing table (18) at the upper end (17A) of the front walls (17) of the winding box (16) is achieved by diagonal braces (31).

Guide surfaces (12) extending the width of the machine extend the gap (GP) through which the web passes, formed by the swingable side walls (11), with the gap spreading in the direction of the incoming web (PB). Compressed-airjets (13) arranged in the guide surfaces (12)make threading of the web to be wound and winding it around king roll (TW1) easier.

Having thus described the invention, it is claimed:

1. A winding device for winding webs, said device comprising two support rolls supporting the roll to be formed in a winding bed, each of said two support rolls having an axis whereby a running web passing through a separation gap between said two support rolls is partly wound around said one of said two support rolls during winding, a space delimited by the two support rolls, means for sealing said space at a front end of said space and from below said separation gap between said two support rolls, means for generating an excess pressure in said space for relieving the weight of the roll, said sealing means being arranged stationary below said separation gap and comprising a pivotable side wall having a pivot axis extending substantially over an entire maximum web width of the roll to be formed, said pivot axis being about parallel to said axes of said two support rolls and capable of pivoting towards said one of said two support rolls around which said web is wrapped, leaving a web passage gap for said web to pass through and forming a seal for the winding process, and can be pivoted away from said one of said two support rolls around which the web is wound.

2. A winding device according to claim 1, wherein said web passage gap which is formed by the pivotable side wall, is extended by a plurality of guide surfaces at a radial distance from said one of two said support rolls in a direction of said web.

3. A winding device according to claim 2, wherein at least one compressed gas jet is arranged in said guide surfaces.

4. A winding device according to claim 1, wherein said sealing means comprises a sealing surface pivotable about one of said support rolls axes to a position at a front end surface of the already formed roll, and said sealing surface has partial surfaces that can be pivoted away from the sealing position about an axis extending along a pivot axis essentially perpendicular to the winding axis or the roll, so that the pivot radius of the sealing surface when the partial surfaces are pivoted away from the rolls is reduced in comparison to a front end surface of the roll.

5. The winding device according to claim 4, wherein said axes of said two support rolls are substantially horizontal and said axis of said partial surface is substantially vertical.

6. The winding device according to claim 5, wherein said pivoting of said partial surfaces is produced by extensible and retractable drive members.

7. The winding device according to claim 6, wherein said members include a cylinder and a piston.

8. The winding device according to claim 4, wherein said pivoting of said partial surfaces is produced by extensible and retractable drive members.

9. The winding device according to claim 8, wherein said members include a cylinder and a piston.

10. A winding device according to claim 1, wherein said sealing means below the separation gap comprises a wind box that is fixed stationary in place with respect to said two support rolls.

11. A winding device according to claim 10, wherein said wind box comprises a front wall and a sealing table, said front wall having an upper end, said sealing table extending between said upper end of said front wall and said two support rolls.

12. A winding device according to claim 11, wherein said sealing means comprises sealing surfaces for sealing front end surfaces of the roll which the sealing surfaces comprise an upper and a lower end and at the lower end comprising a sealing plate arranged approximately perpendicular away from the front end surfaces of the roll and approximately parallel to the axis of said roll.

13. A winding device according to claim 1, wherein said sealing means comprises a wind box which comprises a front wall and a sealing table, said front wall having an upper end and said sealing table extending between said upper end of said front wall and said two support rolls.

14. A winding device according to claim 10, wherein said sealing means comprises sealing surfaces for sealing front end surfaces of the roll which the sealing surfaces comprise an upper and a lower end and at the lower end comprising a sealing plate arranged approximately perpendicular away from the front end surfaces of the already formed roll and approximately parallel to the axis of said roll.

15. A winding device according to claim 1, wherein said sealing means comprises sealing surfaces for sealing front end surfaces of the already formed roll which comprises an upper and a lower end and at the lower end comprising a sealing plate arranged approximately perpendicular away from the front end surface of the roll and approximately parallel to the axis of said roll.

16. A winding device according to claim 1, wherein one of said two support rolls includes a first deformable cover, the other of said two support rolls includes a second deformable cover, said first deformable cover being of different deformability than said second deformable cover.

17. A winding device for winding webs, said device comprising two support rolls supporting the roll to be formed in a winding bed, each of said two support rolls having an axis whereby a running web passes through a separation gap between said two support rolls, a space delimited by the two support rolls, means for sealing said space at a front end of said space and from below said separation gap between said two support rolls, means for generating an excess pressure in said space for relieving the weight of the roll, said sealing means being arranged stationary below said separation gap and comprising a sealing surface pivotable about one of said support rolls axes to a position at a front end surface of the already formed roll, and said sealing surface having partial surfaces that can be pivoted away from the sealing position about an axis extending along a pivot axis essentially perpendicular to the winding axis or the roll, so that the pivot radius of the sealing surface when the partial surfaces are pivoted away from the rolls is reduced in comparison to a front end surface of the roll, said sealing means leaving a web passage gap for said web to pass through and forming a seal for the winding process.

18. A winding device according to claim 17, wherein said sealing means comprises a pivotable side wall having a pivot axis extending substantially over an entire maximum web width of the roll to be formed, said pivot axis being about parallel to said axes of said two support rolls and capable of pivoting towards said one of said two support rolls around which said web is wrapped.

19. A winding device according to claim 18, wherein said web passage gap which is formed by the pivotable side wall, is extended by a plurality of guide surfaces at a radial distance from said one of two said support rolls in a direction of said web.

20. A winding device according to claim 19, wherein at least one compressed gas jet is arranged in said guide surfaces.

21. A winding device according to claim 17, wherein said sealing means below the separation gap comprises a wind box that is fixed stationary in place with respect to said two support rolls.

22. A winding device according to claim 21, wherein said wind box comprises a front wall and a sealing table, said front wall having an upper end, said sealing table extending between said upper end of said front wall and said two support rolls.

23. A winding device according to claim 22, wherein said sealing means comprises sealing surfaces for sealing front end surfaces of the roll which the sealing surfaces comprise an upper and a lower end and at the lower end comprising a sealing plate arranged approximately perpendicular away from the front end surfaces of the roll and approximately parallel to the axis of said roll.

24. A winding device according to claim 21, wherein said sealing means comprises sealing surfaces for sealing front end surfaces of the roll which the sealing surfaces comprise an upper and a lower end and at the lower end comprising a sealing plate arranged approximately perpendicular away from the front end surfaces of the already formed roll and approximately parallel to the axis of said roll.

25. A winding device according to claim 17, wherein said sealing means comprises sealing surfaces for sealing front end surfaces of the already formed roll which comprises an upper and a lower end and at the lower end comprising a sealing plate arranged approximately perpendicular away from the front end surface of the roll and approximately parallel to the axis of said roll.

26. A winding device according to claim 17, wherein said sealing means comprises a wind box which comprises a front wall and a sealing table, said front wall having an upper end and said sealing table extending between said upper end of said front wall and said two support rolls.

27. The winding device according to claim 17, wherein said axes of said two support rolls are substantially horizontal and said axis of said partial surface is substantially vertical.

28. The winding device according to claim 27, wherein said pivoting of said partial surfaces is produced by extensible and retractable drive members.

29. The winding device according to claim 28, wherein said members include a cylinder and a piston.

30. The winding device according to claim 17, wherein said pivoting of said partial surfaces is produced by extensible and retractable drive members.

31. The winding device according to claim 30, wherein said members include a cylinder and a piston.

* * * * *